US005555925A

United States Patent [19]

Sato et al.

[11] Patent Number: 5,555,925

[45] Date of Patent: Sep. 17, 1996

[54] VACUUM CASTING APPARATUS USING FLANGE-FREE STALK

[75] Inventors: Mituyoshi Sato, Toyota; Minoru Uozumi, Aichi-gun; Masao Nakayama, Toyota, all of Japan

[73] Assignee: Toyota Jidosha Kabushiki Kaisha, Toyota, Japan

[21] Appl. No.: 307,424

[22] Filed: Sep. 19, 1994

[30] Foreign Application Priority Data

Oct. 12, 1993 [JP] Japan ..... 5-254408

[51] Int. Cl.[6] ..... B22D 18/06

[52] U.S. Cl. ..... 164/255; 164/63

[58] Field of Search ..... 164/63, 65, 254, 164/255

[56] References Cited

FOREIGN PATENT DOCUMENTS 3925373 2/1990 Germany .

OTHER PUBLICATIONS

Soviet Patent Abstracts, SU–A–1637 949, PQ section, week 9209, Apr. 15, 1992, Derwent Publications.

*Primary Examiner*—Kuang Y. Lin
*Attorney, Agent, or Firm*—Oliff & Berridge

[57] ABSTRACT

A vacuum casting apparatus secures gas tightness of the die cavity without welding together a straight-tubular stalk and a flange or flanges, thus permitting an excellent quality casting. Two flanges are mounted in a mutually spaced-apart relation on an outer periphery of a stalk, and secured between a gas-tight chamber and a die. The gas-tight chamber is fitted on the die from above to form a gas-tight space between the two flanges. The space is evacuated to a pressure close to an inner pressure formed in a cavity of the die during vacuum casting. Thus, air that intrudes into the cavity of the die through small gaps between the flanges and the stalk is reduced, thereby preventing casting defects which might otherwise result. An end of the stalk inserted into the die is also spread to bring an outer periphery of the stalk into close contact with an inner periphery of a flange mounted on the stalk. A first degree of vacuum is applied to the gas-tight chamber to draw molten metal through the stalk to a level above the insertion end of the stalk, and below an inlet of the die cavity, so that the molten metal cools and forms a gas-tight seal about the insertion end of the stalk, before a second degree of vacuum is applied to withdraw molten metal into the die cavity.

4 Claims, 14 Drawing Sheets

FIG. 3 (A)
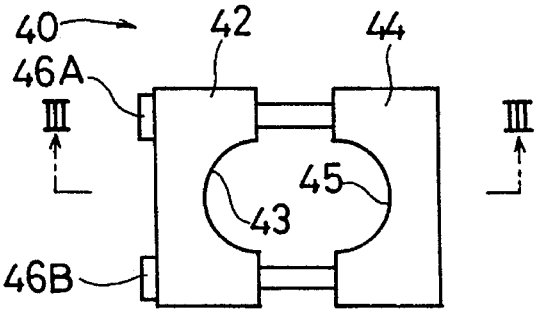
FIG. 3 (B)
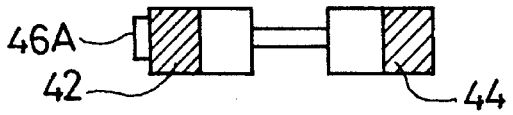
FIG. 4 (A)
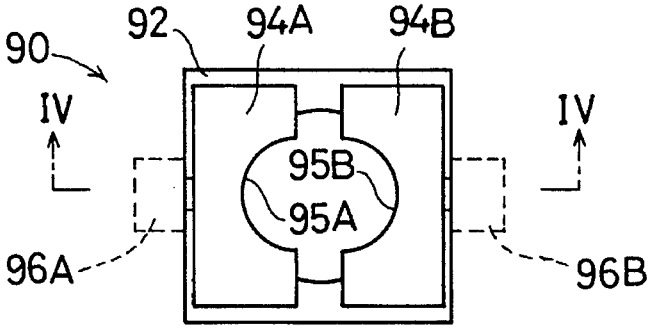
FIG. 4 (B)
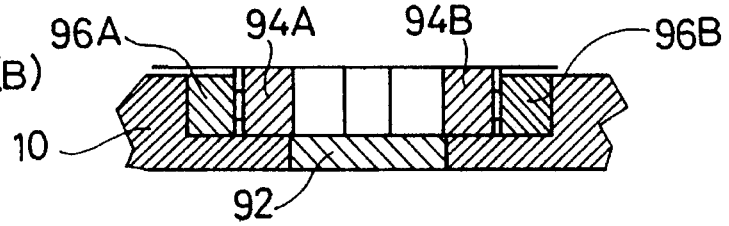
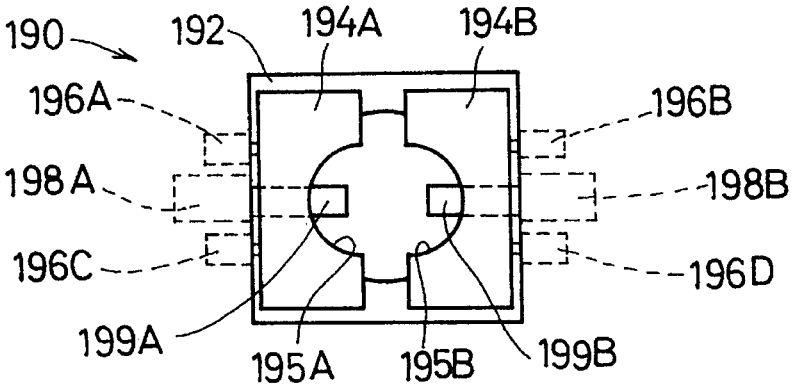
FIG. 5

VACUUM CASTING APPARATUS USING FLANGE-FREE STALK

BACKGROUND OF THE INVENTION

1. Field of the Invention

This invention relates to improvements in the vacuum casting apparatus in which a gas-tight chamber for accommodating a die is evacuated to evacuate a die cavity so as to lead molten metal through a stalk into the evacuated cavity.

2. Description of the Prior Art

In the above vacuum casting apparatus, a melting furnace for storing molten metal in its molten state is disposed outside the gas-tight chamber and connected to the cavity via the stalk. To this end, the wall of the gas-tight chamber has a through hole through which the stalk is passed. In order to be able to obtain satisfactory evacuation in the gas-tight chamber, it is necessary to provide satisfactory seal of the gap between the surface of the through hole and the stalk. To meet this requirement, many techniques have been proposed.

The most well-known one of these techniques is a system in which the gap is sealed with a flange extending from the outer periphery of the stalk. A contrivance for obtaining a better seal with such a flange is disclosed in Japanese Laid-Open Patent Publication No. 63-84757. FIG. 20 shows this technique. In this technique, a lower wall member 511 is detachably mounted on the underside of a gas-tight chamber 502 via a seal 512. A sub-chamber 514 is thus formed by the gas-tight chamber 502 and the lower wall member 511, and is communicated with the gas-tight chamber 502 via a through hole 522. The gap between the lower wall member 511 and a stalk 505 is sealed with a flange 505*a* formed on the outer periphery of the stalk 505. In this system, the sub-chamber 514 is evacuated, and thus it is possible to hold the amount of air intruding through the gap between the surface of the through hole 502*b* of the gas-tight chamber 502 and the stalk 505 to be low.

This system is an effective technique insofar as obtaining satisfactory gas-tight chamber evacuation. However, it is necessary to provide the flange 505*a* on the outer periphery of the stalk 505.

The stalk should not be one which contaminates the molten metal by releasing impurities thereinto when exposed to the high temperature of the molten metal. Accordingly, it has been contemplated to form the stalk with the same metal as the molten metal. Where the stalk and the molten metal are of the same metal, the problem of the contamination of molten metal is not posed.

Where the stalk is made of the same metal as the molten metal, it is readily melted. Therefore, it has to be replaced frequently, although the used stalk can be used as the material of the molten metal and does not lead to any waste of material. However, since the stalk is replaced frequently, it is required to form the stalk inexpensively.

Heretofore, a flange has been provided on the outer periphery of the stalk to permit improvement of the seal. Such a flange, however, dictates a cumbersome step of its formation. A problem is thus posed in connection with the cost of the flange formation on the stalk. In this background, there has been a demand for a technique for obtaining satisfactory seal of the gap with a flange-free stalk (hereinafter referred to as straight-tubular stalk).

A technique which is disclosed in Japanese Laid-Open Patent Publication No. 2-284962 will now be described with reference to FIG. 18.

FIG. 18 shows a vacuum casting apparatus 402 which mainly comprises a die 404 made of sand and a gas-tight surface plate 420 on which the die 404 rests. The die 404 comprises an upper and a lower die half 406 and 408 overlapped over each other to form an inner cavity 410 having a shape complementary to the product shape.

Gas tightness means 418 is provided on the upper surface of the gas-tight surface plate 420. The gas tightness means 418 is constituted by a member which, when the die 404 is set on the gas-tight surface plate 420, is pushed into the lower die half 408 made of sand to push a portion of the lower die half 408 surrounding a sprue 416 toward the center thereof.

In the vacuum casting using the vacuum casting apparatus 402, first the upper and lower die halves 406 and 408 of the die 404 are assembled together with a frame member 412 secured to their portions with the intervening seam therebetween. Then, a straight-tubular stalk 430 is inserted into the sprue 416 provided on the underside of the die 404 assembled in the above way.

Then, the die 404 is set on the gas-tight surface plate 420 with the stalk 430 inserted therethrough. At this time, the gas tightness means 418 provided on the gas-tight surface plate 420 is pushed into the lower die half 408. As a result, the wall of the sprue 416 is pushed against the outer periphery of the stalk 430, so that the gas tightness between the stalk 430 and the sprue 416 is secured.

Further, stalk securing means 422 provided on the underside of the gas-tight surface plate 420 is tightened by an air cylinder mechanism 424 to secure the stalk 430 to the gas-tight surface plate 420. Thereafter, a gas-tight chamber 414 is mounted to enclose the die 404, and its portion in contact with the gas-tight surface plate 420 is sealed, thus forming a gas-tight space surrounding the die 404.

In this state, the lower end of the stalk 430 is dipped in molten metal M40, and the pressure in the gas-tight chamber 414 is reduced by a vacuum pump 434 via a vacuum tubing 432 connected to the gas-tight surface plate 420. Thus, the molten metal M40 is withdrawn into the stalk 430 and fills the cavity 410. In this way, vacuum casting can be performed using the straight-tubular stalk 430 having no flange thereon.

In the above vacuum casting apparatus 402, the gas tightness means 418 is provided to obtain close contact between the sprue 416 of the die 404 and the stalk 430. However, where the die 404 of sand is formed by making use of chemical hardening based on a binder, it can be deformed very slightly, so that it is difficult to obtain close contact of the inner wall of the sprue 416 with the outer periphery of the stalk 430.

Therefore, it is impossible to ensure sufficient gas tightness, and external air penetrated through the gap between the stalk 430 and the die 404 is introduced into the cavity 410 at the time of the evacuation, thus resulting in the formation of pores or voids in the casting to deteriorate the characteristics of the product. That is, a problem is posed that excellent casting quality which is a feature of the vacuum casting process can not be obtained. Further, with a deformable sand die made of raw sand or the like, falling of sand, deformation of unnecessary portion, etc., are liable to take place at the time of the deformation by the gas tightness means 418.

Another technique which also uses a straight-tubular stalk is disclosed in Japanese Laid-Open Patent Publication No. 4-294854. This technique will now be described with reference to FIG. 19.

Referring to FIG. 19, designated at 450 is a die, at 452 a gas-tight surface plate, at 460 a straight-tubular stalk, and at 430 a flexible seal member. Designated at 440A and 440B are seal retainer halves like ring halves having a tapered outer periphery. The gas-tight surface plate 452 has a through hole 452*a* which has a complementary taper shape.

With this arrangement, when the seal retainer halves 440A and 440B are pushed down by the die 450 set on the gas-tight surface plate 452, their taper surfaces compress the seal member 430. As a result, the seal between the gas-tight surface plate 452 and the stalk 460 is enhanced. The gap between the gas-tight surface plate 452 and the stalk 460 thus can be sealed well, thus considerably alleviating the inconvenience of void formation or the like due to trapping of bubbles in the casting. However, the seal obtainable with this system is inferior to the seal obtainable with the system using a stalk with a flange.

SUMMARY OF THE INVENTION

An object of the invention is to further improve the gas tightness between the straight-tubular stalk and the gas-tight chamber.

In one form of the invention, two flanges are mounted on a straight-tubular stalk, and the space between the two flanges is evacuated.

In another form of the invention, a flange is mounted on a straight-tubular stalk, and molten metal is introduced into and subsequently hardened in the gap between the flange and the straight-tubular stalk, thus securing the gas tightness between the two components.

In a further form of the invention, a flange is mounted on a straight-tubular stalk, and subsequently the stalk is spread outward from the inside, thus securing seal between the stalk and the flange.

In either of the above forms of the invention, the stalk may use one which is formed by bending a single metal sheet into the form of a pipe.

The present invention will be more fully understood from the following detailed description and appended claims when taken with the accompanying drawings.

BRIEF DESCRIPTION OF THE DRAWINGS

FIGS. 3(A) and 3(B) are a plan view and a front view, respectively, showing the essential parts of a vacuum casting apparatus according to a third embodiment;

FIGS. 4(A) and 4(B) are a plan view and a front view, respectively, showing the essential parts of a vacuum casting apparatus according to a fourth embodiment;

FIG. 5 is a plan view showing the essential parts of a vacuum casting apparatus according to a fifth embodiment;

DETAILED DESCRIPTION OF THE PREFERRED EMBODIMENTS

First Embodiment

Figure 1:
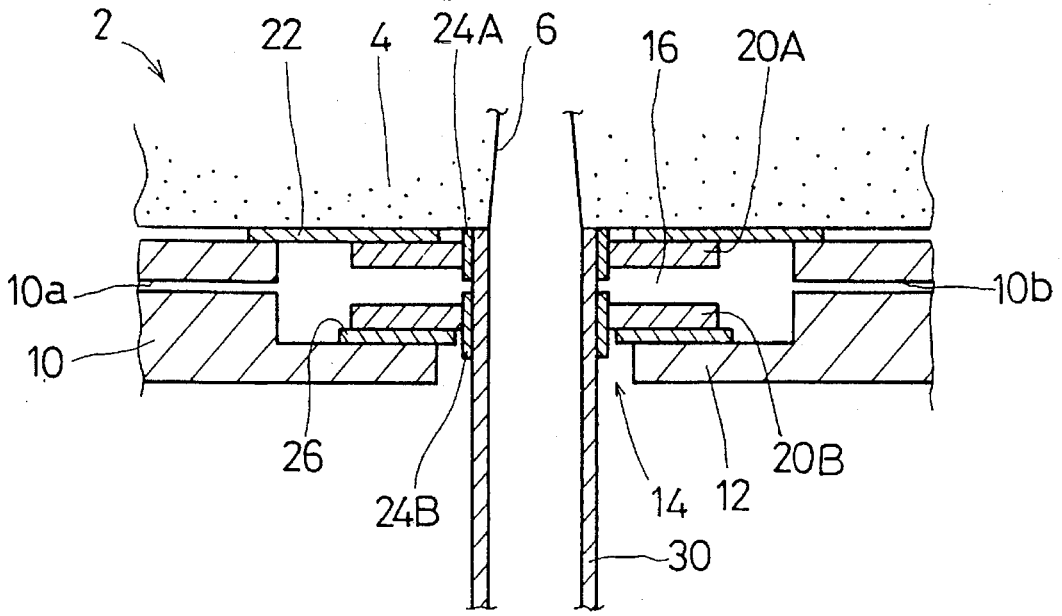
FIG. 1 is a sectional view showing the essential parts of a vacuum casting apparatus according to a first embodiment of the invention.

Now, a first embodiment of the invention will be described with reference to FIG. 1. FIG. 1 is a sectional view showing the essential parts of a vacuum casting apparatus 2 according to the first embodiment of the invention. This embodiment is featured in that intrusion of external air is effectively prevented by reducing pressure in a space between two flanges.

As shown in FIG. 1, the vacuum casting apparatus 2 mainly comprises a die 4 made of shell sand, a gas-tight surface plate 10 for supporting the die 4 set thereon, and a straight-tubular stalk 30 connected to the die 4 via the gas-tight surface plate 10. The stalk 30 is a pipe made of the same material as molten metal which is the casting material.

Two flanges 20A and 20B are mounted in a spaced-apart relation to each other on the stalk 30 near the upper end thereof. These flanges 20A and 20B are mounted via respective peripheral seal members 24A and 24B on the outer periphery of the stalk 30.

The flanges 20A and 20B are doughnut-like in shape and are mounted on the stalk 30 by compressing the peripheral seal members 24A and 24B which are capable of deformation. The flanges 20A and 20B are secured to the outer periphery of the stalk 30 by a positioning mechanism (not shown) such that they will not be deviated in the longitudinal direction of the stalk 30.

The stalk 30 with the flanges 20A and 20B mounted thereon is mounted on the die 4 via the gas-tight surface plate 10. Specifically, as shown in FIG. 1, the flange 20B is set via a flat lower seal member 26 in a central flange support section 12 provided in the gas-tight surface plate 10. On the other hand, on the top surface of the other flange 20A is mounted a flat upper seal member 22 on which the die 4 is set. At this time, the mounting position of the upper flange 20A, the thickness of the upper seal member 22, etc. are adjusted such that the upper end of the stalk 30 is in close contact with the lower end of a sprue 6 of the die 4. A gas-tight chamber (not shown) is fitted from above to enclose the die 4, and its surface in contact with the gas-tight surface plate 10 is sealed, so that a gas-tight space surrounding the die 4 is formed. In this way, the stalk 30 is secured to the gas-tight surface plate 10 such that it downwardly penetrates an opening or hole 14 of the gas-tight surface plate 10.

The gas-tight surface plate 10 has a pair of communication holes 10*a* and 10*b* formed above the flange support section 12. The communication holes 10*a* and 10*b* are connected via openings (not shown) to an external vacuum pump (not shown). By operating this vacuum pump, the pressure in a space 16 defined by the flanges 20A and 20B, die 4 and gas-tight surface plate 10 is reduced.

As a result, the pressure in the space 16 is reduced compared to the external pressure to approach the pressure in a cavity (not shown) in the die 4 during the vacuum casting. Thus, even if there are gaps formed between the flanges 20A and 20B and the stalk 30 because these parts are not welded together, it is possible to reliably prevent the generation of casting defects that might otherwise result from intrusion of external air through such gaps into the cavity.

Thus, in the vacuum casting apparatus 2 of this embodiment, without welding of the flanges 20A and 20B and the stalk 30 to one another, it is possible to obtain a homogeneous, excellent quality casting free from internal defects which is a merit of the vacuum casting process.

Second Embodiment

Figure 2:
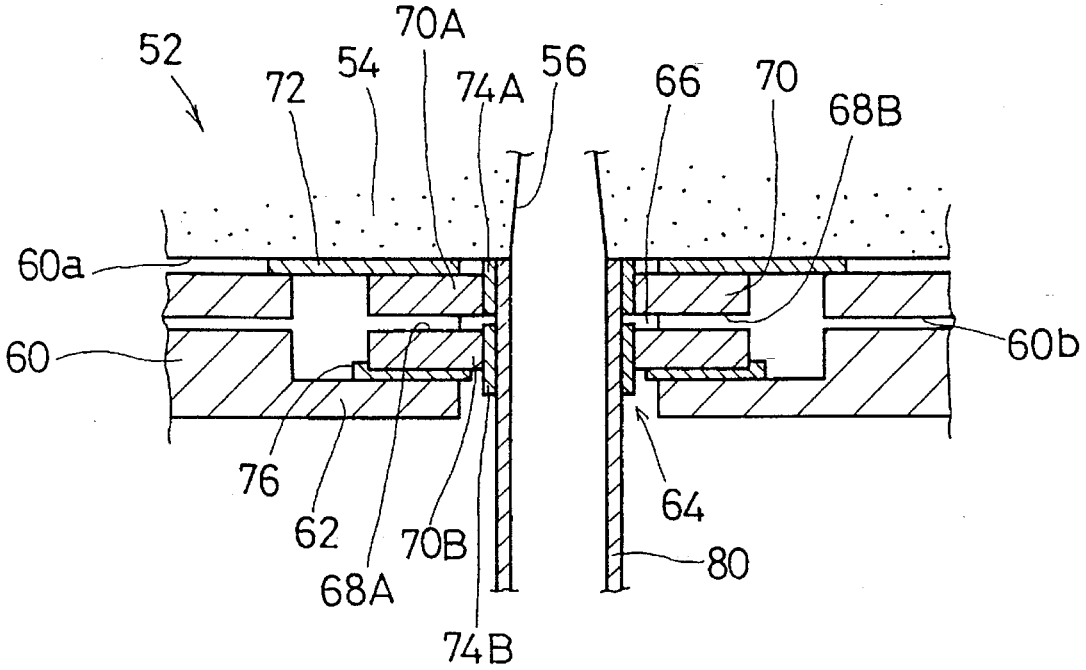
FIG. 2 is a sectional view showing the essential parts of a vacuum casting apparatus according to a second embodiment.

A second embodiment of the invention will now be described with reference to FIG. 2. FIG. 2 is a sectional view showing the essential parts of a vacuum casting apparatus 52 according to the second embodiment of the invention.

As shown in FIG. 2, the vacuum casting apparatus 52 mainly comprises a die 54 made of shell sand, a gas-tight surface plate 60 and a straight-tubular stalk 80.

In this embodiment, unlike the first embodiment, only a single flange 70 is mounted on the stalk 80 at the upper end thereof. The flange 70 has two, i.e., an upper and a lower, flange portions 70A and 70B defining an intervening space 66. A pair of communication holes 60*a* and 60*b* are provided to communicate the space 66 with the outside.

The flange 70 is mounted on the outer periphery of the stalk 80 via seal members 74A and 74B provided between the stalk 80 and the upper and lower flange portions 70A and 70B, respectively. The flange 70 is secured to the stalk 80 by a positioning mechanism (not shown) such that it will not be deviated in the longitudinal direction of the stalk 80. The flange 70 is sealed to the die 54 by a flat upper seal member 72 and to a flange support section 62 of the gas-tight surface plate 60 by a lower seal member 76. Further, the upper end of the stalk 80 is adjusted such as to be in close contact with a sprue 56 of the die 54.

In the vacuum casting apparatus 52 of this embodiment, with operation of an external vacuum pump (not shown) which is connected to communication holes 60*a* and 60*b* provided in the gas-tight surface plate 60, the pressure in the space 66 is reduced through the communication holes 60*a* and 60*b* of the gas-tight surface plate 60 and the communication holes 68A and 68B of the flange 70.

As a result, the pressure in the space 66 is reduced to approach the pressure in a cavity (not shown) in the die 54 during the vacuum casting process. This has an effect of reliably preventing the otherwise possible intrusion of external air into the cavity through small gaps between the seal members 74A and 74B and the inner surface of the flange 70 or the outer periphery of the stalk 80.

Thus, in the vacuum casting apparatus 52 of this embodiment, it is possible to obtain the same effects as in the first embodiment by using a single flange 70 which is in contact at two positions with the stalk 80. The embodiment thus has an advantage over the first embodiment that readier flange mounting is possible.

Third Embodiment

A third embodiment of the invention will now be described with reference to FIGS. 3(A) and 3(B). FIGS. 3(A) and 3(B) are a plan view and a sectional view, respectively, showing the essential parts of a vacuum casting apparatus according to the third embodiment of the invention. This embodiment is featured in that the flange member mounted on the outer periphery of the stalk, as described before in connection with the first and second embodiments, is divided horizontally into two halves.

As shown in FIGS. 3(A) and 3(B), a flange 40 in this embodiment comprises paired flange halves 42 and 44 and tightening bolts 46A and 46B screwed in the flange halves 42 and 44. The flange half 42 is mounted on the tightening bolts 46A and 46B such that it can be rotated but not be axially displaced relative to these bolts. The other flange half 44 has female threads screwed on end male threaded portions of the tightening bolts 46A and 46B.

The flange halves 42 and 44 have half circular clamping surfaces 43 and 45 facing each other, and then the flange halves 42 and 44 are tightened together, so that a central circular opening is formed in the flange 70. In this circular opening, the straight-tubular stalk, such as the stalk 30 or 80 noted before, is clamped.

By turning the tightening bolts 46A and 46B clockwise, the flange halves 42 and 44 are brought toward each other, and by counterclockwise turning, the flange halves 42 and 44 are brought away from each other. In this way, the distance between the two flange halves 42 and 44 are adjustable. Further, the flange halves 42 and 44 can be separated from each other by taking out the bolts 46A and 46B from the female threads of the flange half 44.

With the above arrangement, the flange 40 in this embodiment can be mounted on and dismounted from the stalk in the horizontal direction. This has an advantage that the flange 40 can be mounted in the direction toward the outer periphery of the stalk after mounting the stalk in the gas-tight surface plate, and this extends the degree of freedom of operation. In addition, after vacuum casting, the sole flange 40 can be removed without vertically moving the stalk relative to the gas-tight surface plate. Thus, the stalk can be taken out upward as well as downward. That is, the freedom of the stalk take-out direction is increased, which is desired for the automation of the casting process using such vacuum casting apparatus.

Fourth Embodiment

A fourth embodiment will now be described with reference to FIGS. 4(A) and 4(B). FIGS. 4(A) and 4(B) are a plan view and a sectional view, respectively, showing the essential parts of a vacuum casting apparatus according to the fourth embodiment. In this embodiment, like the third embodiment, a flange is used which is separable into two halves in the horizontal direction.

As shown in FIGS. 4(A) and 4(B), a flange 90 of this embodiment comprises paired flange halves 94A and 94B which are slidably mounted on a flange base 92 and tightening cylinder mechanisms 96A and 96B for causing sliding movement of these flange halves 94A and 94B.

The flange halves 94A and 94B, like the flange halves 42 and 44 in the third embodiment, have half circular clamping surfaces 95A and 95B. Further, as shown in FIG. 4(B), all the components of the flange 90 are embedded in the gas-tight surface plate 10.

With this structure of the flange 90 in this embodiment, the flange halves 94A and 94B can be mechanically tightened and loosened relative to each other. Thus, the tightening force can be readily secured, and it is possible to permit automatic opening and closing of the flange 90. Further, since the entire flange is embedded in the gas-tight surface plate, unlike the flanges shown in FIGS. 1, 2, 3(A) and 3(B), the flange can be mounted without taking substantial time.

Fifth Embodiment

A fifth embodiment of the invention will now be described with reference to FIG. 5. FIG. 5 is a plan view showing the essential parts of a vacuum casting apparatus according to the fifth embodiment of the invention.

As shown in FIG. 5, the flange 190 in this embodiment comprises paired flange halves 194A and 194B which are mounted slidably on a flange base 192. In the flange base 192, two pairs of tightening screws 196A and 196C, and 196B and 196D, are mounted for causing sliding movement of the flange halves 194A and 194B. In the center of the flange base 192, a pair of, i.e., a left and a right, push rods 199A and 199B are mounted slidably, and push cylinder mechanisms 198A and 198B are provided for causing the sliding movement of the push rods 199A and 199B. Like the flange 90 in the fourth embodiment, the overall flange structure is embedded in the gas-tight surface plate.

With this structure of the flange 190 in this embodiment, the flange halves 194A and 194B can be manually tightened and loosened by turning the tightening screws 196A and 196C, and 196B and 196D. Further, occasionally molten metal may wet and be adhered to the clamping surfaces 195A and 195B of the flange halves 194A and 194B. In such a case, it may be refused to separate the flange halves 194A and 194B from the outer periphery of the stalk. Even in such a case, it is possible to separate the clamping surfaces 195A and 195B of the flange halves 194A and 194B from the stalk and take out the flange halves 194A and 194B from the stalk by operating the push cylinder mechanisms 198A and 198B to advance the push rods 199A and 199B.

Sixth Embodiment

A sixth embodiment of the invention will now be described with reference to FIGS. 6, 7(A) to 7(D) and 8(A) to 8(C). FIGS. 6, 7(A) to 7(D) and 8(A) to 8(C) are front views showing part of a vacuum casting apparatus according to the sixth embodiment of the invention. This embodiment is featured in that a stalk which is made of a deformable metal material is spread to bring the stalk into contact with a flange.

Figure 6:
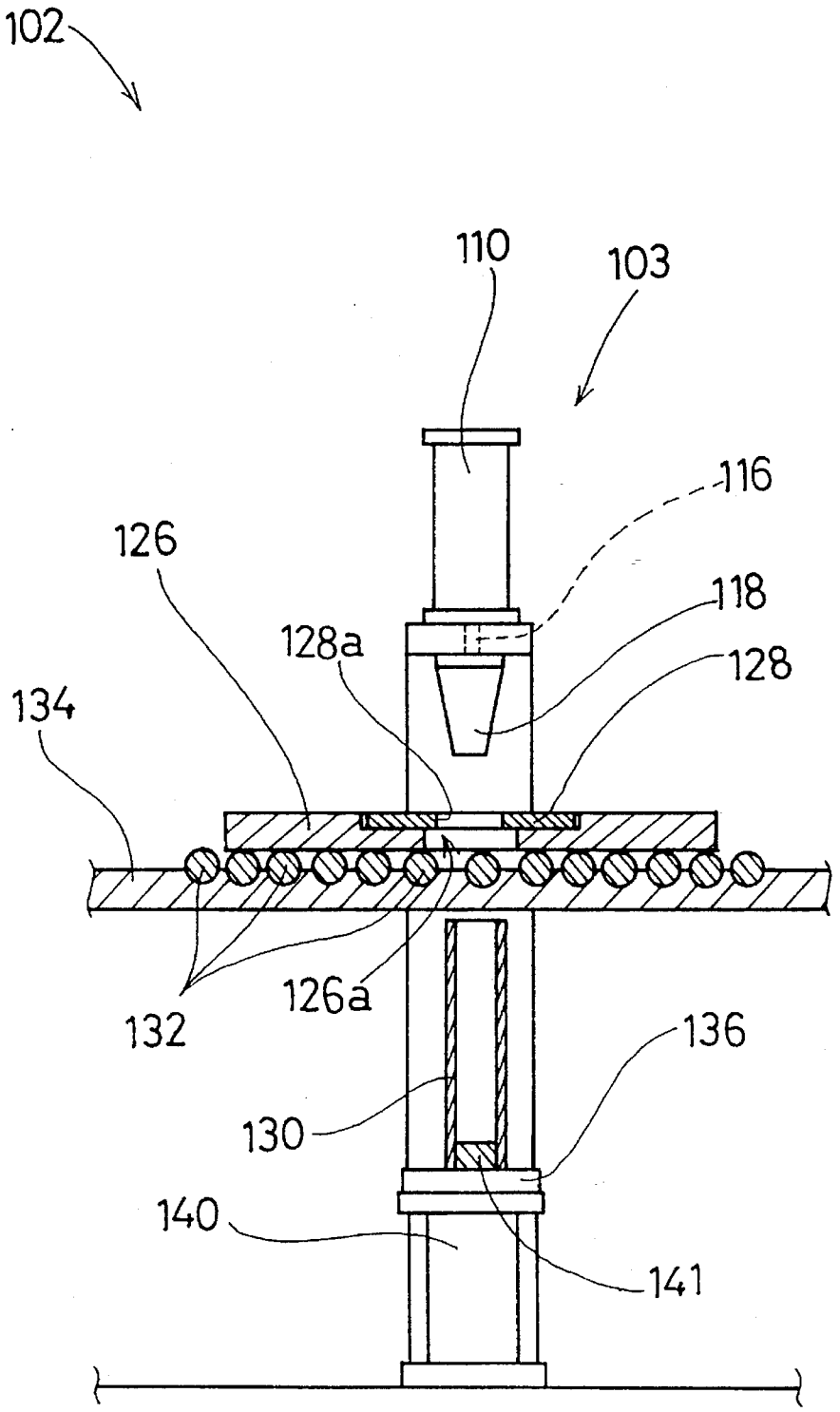
FIG. 6 is a front view showing part of a vacuum casting apparatus according to a sixth embodiment.

As shown in FIG. 6, in the vacuum casting apparatus of this embodiment, a gas-tight surface plate 126 is moved automatically by a roller conveyor 132 provided on a conveyor support 134. Shown in FIG. 6 is a state in which the gas-tight surface plate 126 is located in a stalk spreading section in which a stalk spreading unit 103 is provided.

The stalk spreading unit 103 includes a stalk spreading cylinder mechanism 110, and a stalk spreading member 118 is secured to the lower end of a stalk spreading rod 116. With the operation of the stalk spreading mechanism 110, the stalk spreading rod 116 is vertically advanced and retreated relative to the stalk spreading cylinder mechanism 110 to lower and raise the stalk spreading member 118.

A lift table 136 is disposed underneath the stalk spreading unit 103 and is adapted to be raised and lowered with the operation of a lift cylinder mechanism 140. A support member 141 is secured to the top of the lift table 136, and a stalk 130 is set upright on the lift table 136 with its lower open end fitted on the support member 141. The stalk 130 is a pipe of the same metal material as molten metal which is the casting material. A flange 128 is set in a central opening 126*a* of the gas-tight surface plate 126.

The operation of the stalk spreading unit 103 having the above structure will now be described with reference to FIGS. 6 and 7(A) to 7(D).

Figure 7A:
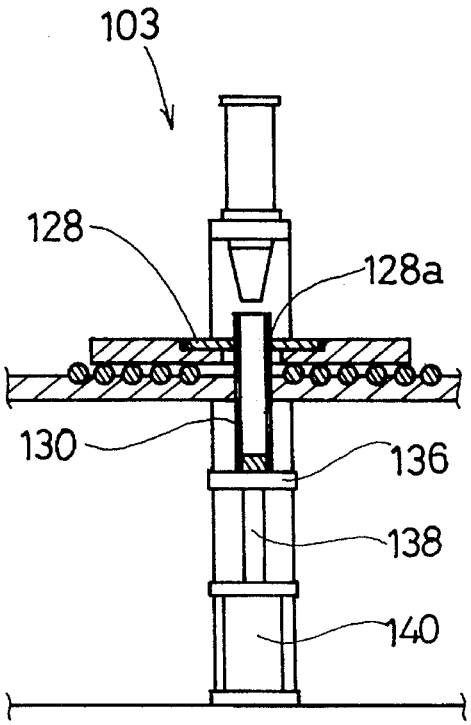
FIGS. 7(A) to 7(D) are front views showing operations of the vacuum casting apparatus according to the sixth embodiment.
Figure 7B:
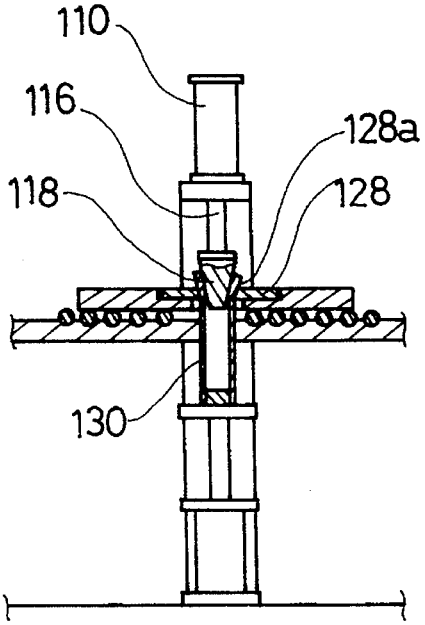

In the state shown in FIG. 6, the lift cylinder mechanism 140 is operated to raise the lift table 136 until the stalk 130 penetrates an opening 128*a* of the flange 128, as shown in FIG. 7(A). Then, the stalk spreading cylinder 110 is operated to lower the stalk spreading member 118 in unison with the stalk spreading rod 116 and thus insert the end of the stalk spreading member 118 into the stalk 130 from the upper end thereof, as shown in FIG. 7(B). As a result, the upper end of the stalk 130 made of a deformable metal material is spread to follow the end shape of the stalk spreading member 118. Thus, the outer periphery of the stalk 130 which is thus spread is pushed against and brought into close contact with the inner surface of the opening 128*a* of the flange 128.

Figure 7C:
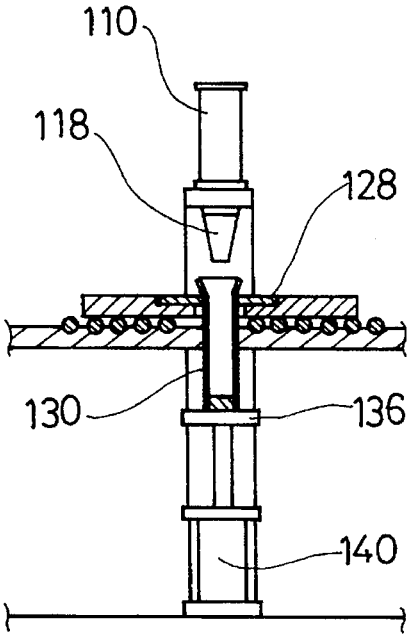
Figure 7D:
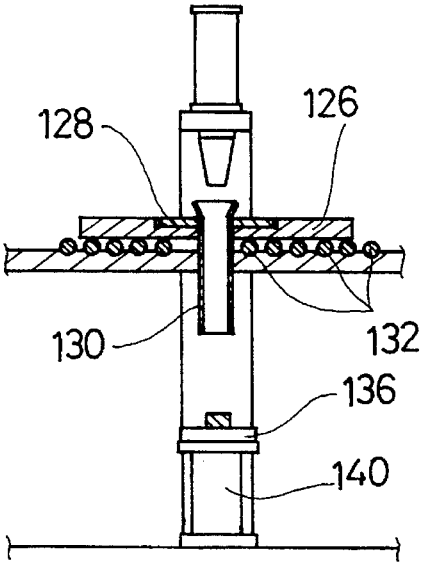

When the stalk spreading member 118 is lowered down to a predetermined height level, the stalk spreading cylinder mechanism 110 is operated to return the stalk spreading member 118 to the initial position, as shown in FIG. 7(C). Then, the lift table 118 is lowered while leaving the stalk 130, as shown in FIG. 7(D), thus bringing an end to the stalk spreading operation by the stalk spreading unit 103.

Figure 8A:
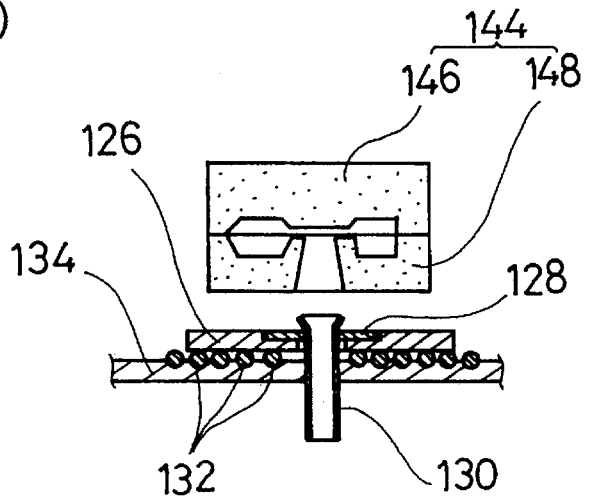
FIGS. 8(A) to 8(C) are front views showing operations following the operations shown in FIGS. 7(A) to 7(D)
Figure 8:
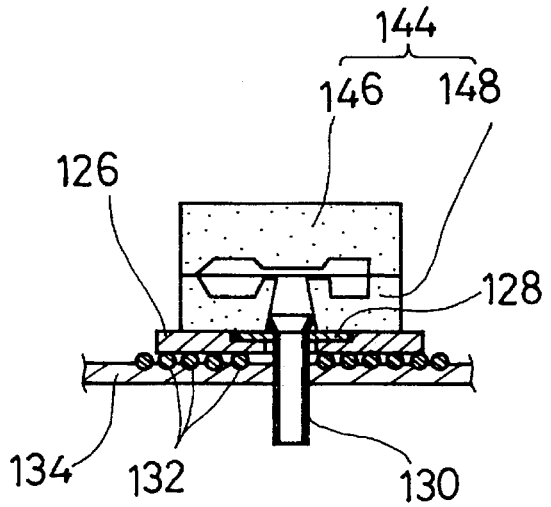
Figure 8:
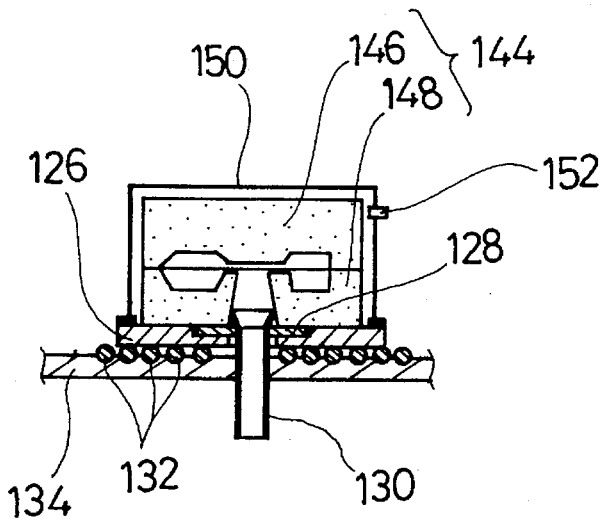

Subsequently, with the operation of the roller conveyor 132, the gas-tight surface plate 126 is moved in the horizontal direction to a casting section as shown in FIGS. 8(A) to 8(C).

In the casting section, a die 144 comprising an upper and a lower die half 146 and 148 is supplied by a die holding mechanism (not shown), as shown in FIG. 8(A). The die 144 is then set on the gas-tight surface plate 126 such that its underside is in close contact with the flange 128, as shown in FIG. 8(B). Then, a gas-tight chamber 150 is supplied by a chamber holding mechanism (not shown) from above the die 144, as shown in FIG. 8(C). In this state, an external vacuum pump (not shown) is operated to evacuate the gas-tight chamber 150 through an vacuum tubing 152 connected to the gas-tight chamber 150. As a result, molten metal is withdrawn through the stalk 130 and fills the cavity in the die 144 for vacuum casting.

As shown, in the vacuum casting apparatus of this embodiment, with the flange 128 fitted on the outer periphery of the stalk 130, the stalk 130 is spread from its inner side by the stalk spreading unit 103 to bring the sprue 130 into close contact with the flange 128. Thus, sufficient gas tightness can be ensured without welding together the stalk and flange, and vacuum casting is carried out under satisfactory conditions.

Seventh Embodiment

Figure 9:
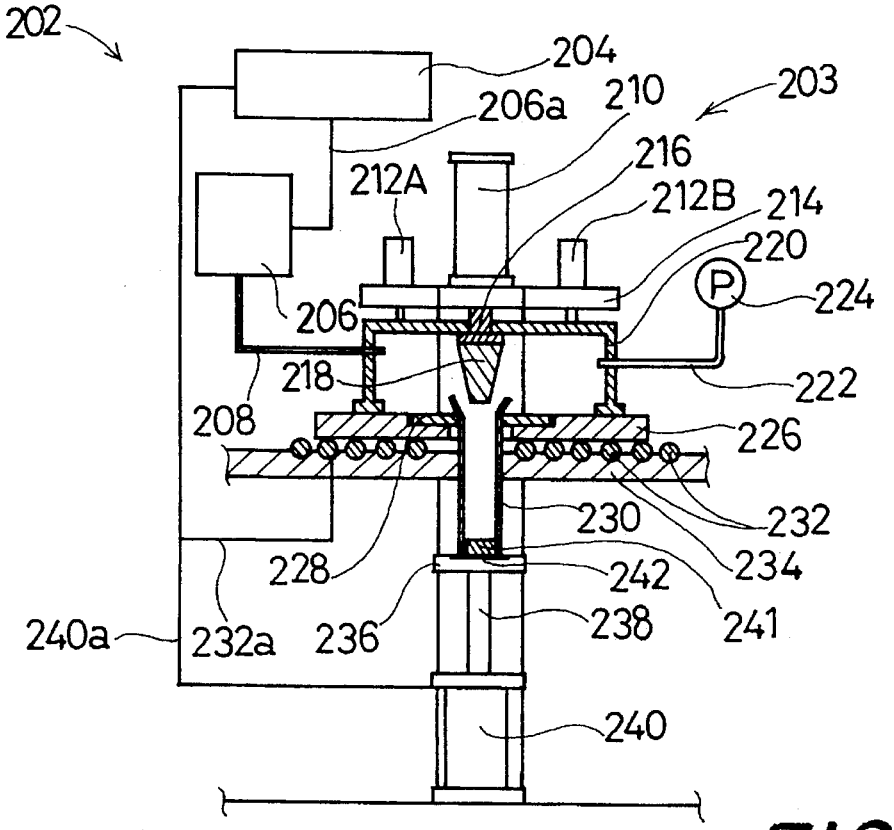
FIG. 9 is a front view showing a vacuum casting apparatus according to a seventh embodiment.

A seventh embodiment of the invention will now be described with reference to FIG. 9. FIG. 9 is a sectional view showing a vacuum casting apparatus 202 according to the seventh embodiment of the invention.

This embodiment, like the sixth embodiment, is a vacuum casting apparatus of the system in which the stalk is spread to be brought into close contact with the flange. This embodiment, however, is featured in that a checking mechanism is provided to check the gas tightness obtained by spreading the stalk.

Specifically, as shown in FIG. 9, the vacuum casting apparatus 202 comprises a stalk spreading unit 203, a gas-tight chamber 220 for measuring the degree of vacuum, a vacuum degree measuring unit 206, a vacuum pump 224, a control unit 204 for controlling the overall operation of the system, etc.

The gas-tight chamber 220, as shown in FIG. 9, is set on a gas-tight surface plate 226 located in the stalk spreading section and is pushed by a push cylinder mechanism 210, so that gas tightness is ensured.

A stalk spreading rod 216 extends into the gas-tight chamber 220, and a stalk spreading member 218 secured to the end of the stalk spreading rod 216. The frictional surfaces of the gas-tight chamber 220 and the stalk spreading rod 216 are sealed together such that the stalk spreading member 218 can be moved vertically without breaking the gas tightness of the gas-tight chamber 220.

A vacuum pump 224 is connected via a vacuum tubing 222 to the gas-tight chamber 220. The vacuum degree measuring unit 206 is connected via a vacuum degree measuring tubing 208 to the gas-tight chamber 220.

A lift table 236, a lift cylinder mechanism 240, a roller conveyor 232, etc. have the same structures as those in the sixth embodiment. Control signal lines 232*a* and 240*a* are led from the control unit 204 and are connected to the roller conveyor 232 and the lift cylinder mechanism 240. A measuring signal line 206*a* is led from the vacuum degree measuring unit 206 and is connected to the control unit 204.

In the vacuum casting apparatus 202 having the above construction, after the operation of spreading a stalk 230 with the stalk spreading member 218 has been carried out, the vacuum pump 224 is operated to reduce pressure in the gas-tight chamber 220. The vacuum degree measuring unit 206 measures the obtained vacuum degree.

The surface of the lift table 236 on which the stalk 230 rests, is sealed by a seal member 242. Thus, the degree of close contact between a flange 228 and the spread stalk 230 is measured as the vacuum degree in the gas-tight chamber 220.

Thus, when a predetermined degree has been attained, a control signal from the control unit 204 is inputted through the control signal line 240*a* to the lift cylinder 240 to cause the lift cylinder 240 to be operated so as to lower the lift table 236. Then, a control signal from the control unit 204 is inputted through the control signal line 232*a* to the roller conveyor 232. In addition, the roller conveyor 232 is operated to move the gas-tight surface plate 226 together with the flange 228 and stalk 230 mounted therein to the next casting section for the next vacuum casting process.

If the predetermined vacuum degree has not been attained, the spread stalk is removed, and a new stalk is supplied for carrying out the stalk spreading operation afresh.

Eighth Embodiment

Figure 10:
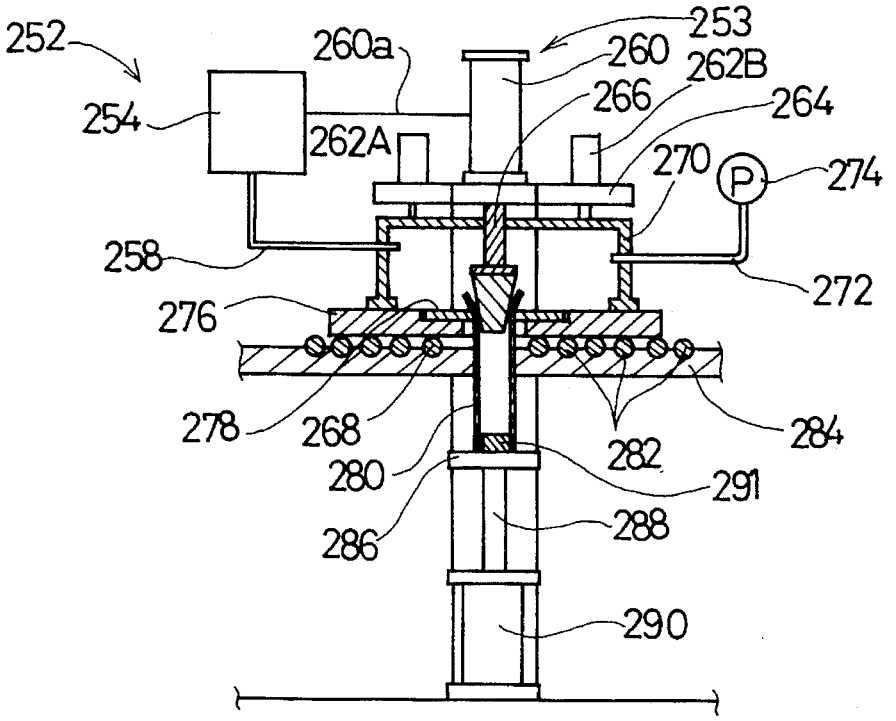
FIG. 10 is a front view showing a vacuum casting apparatus according to an eighth embodiment.

An eighth embodiment of the invention will now be described with reference to FIG. 10. FIG. 10 is a front view showing a vacuum casting apparatus according to the eighth embodiment of the invention.

Again this embodiment, like the seventh embodiment, has a checking mechanism for checking the gas tightness obtained by stalk spreading. This embodiment, however, is featured in that the vacuum degree obtained by the stalk spreading is checked while carrying out the stalk spreading operation.

As shown in FIG. 10, the vacuum casting apparatus of this embodiment comprises a measurement control unit 254 as well as a vacuum degree measuring gas-tight chamber 270, push cylinder mechanisms 262A and 262B, a vacuum pump 274, etc. as in the seventh embodiment. The measurement control unit 254 has the functions of the vacuum degree measuring unit 206 and the control unit 204 in the seventh embodiment, and is connected via a vacuum degree measurement tubing 258 to the gas-tight chamber 270.

A control signal line 260*a* is led from the measurement control unit 254 to a stalk spreading cylinder mechanism 260.

In the vacuum casting apparatus 252 having the above construction, the vacuum degree is measured simultaneously with the stalk spreading operation under control of the measurement control unit 254.

Specifically, as shown in FIG. 10, a stalk 280 rests on a lift table 286 such that it penetrates an opening formed in a flange 278 that is set on a gas-tight surface plate 276. In this state, the stalk spreading cylinder mechanism 260 is operated to lower a stalk spreading member 268 for spreading the stalk 280. At the same time, the vacuum pump 274 is operated to reduce pressure in the space defined by the gas-tight surface plate 276 and the gas-tight chamber 270. The vacuum degree in the space is measured by the measurement control unit 254. Until reaching of a predetermined value by the vacuum degree, the stalk spreading operation is continued under control of a control signal from the measurement control unit 254.

Upon reaching of the predetermined value by the vacuum degree, the stalk spreading member 268 is raised under control of the measurement control unit 254. In this way, the stalk spreading process is ended, and the spread stalk 280 is set on the gas-tight surface plate 276 together with the flange 278 and is fed to the next process station by the roller conveyor 282.

As shown, in this embodiment, the stalk is spread while the vacuum degree is measured. Thus, it is possible to reliably secure the gas tightness by the stalk spreading. In addition, compared to the case of measuring the vacuum degree, the cycle time can be reduced.

Ninth Embodiment

Figure 11A:
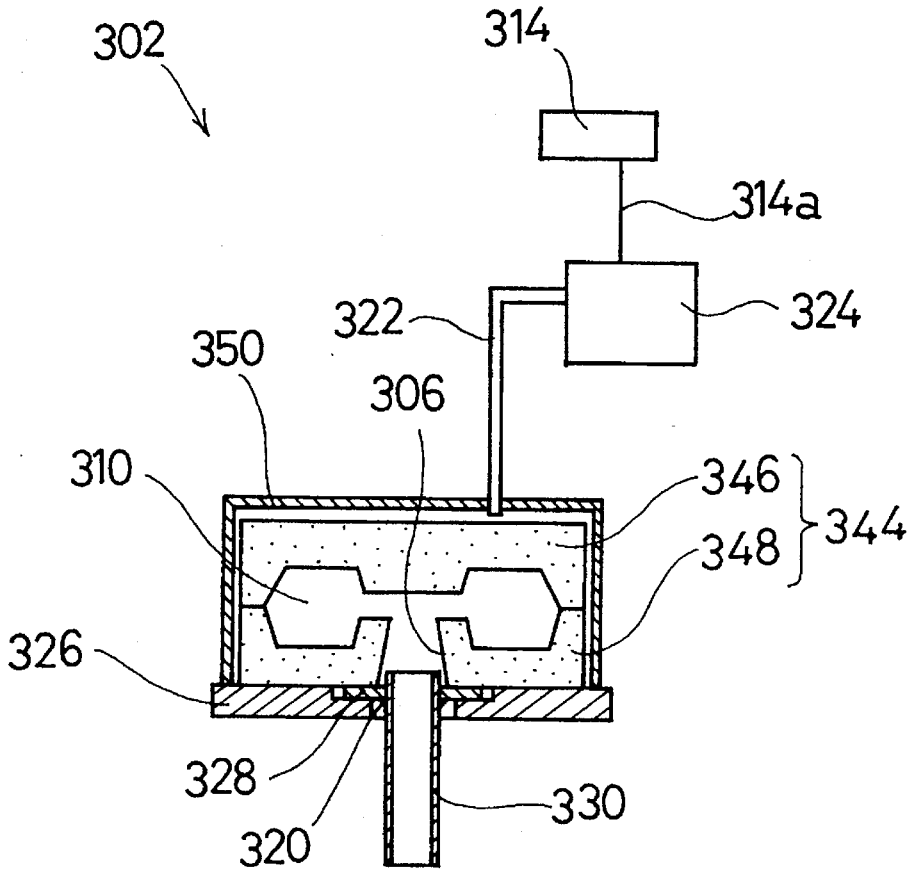
FIGS. 11(A) and 11(B) are a schematic representation and a fragmentary enlarged-scale view, respectively, showing a vacuum casting apparatus according to a ninth embodiment.
Figure 11B:
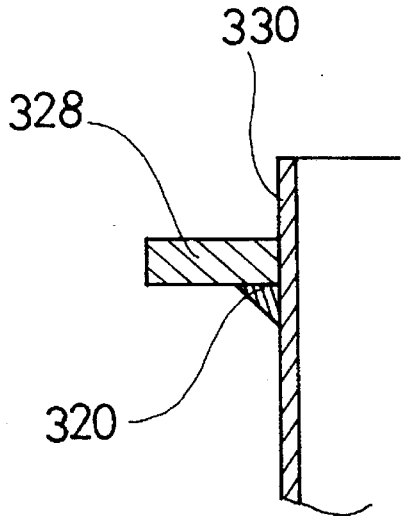
Figure 12A:
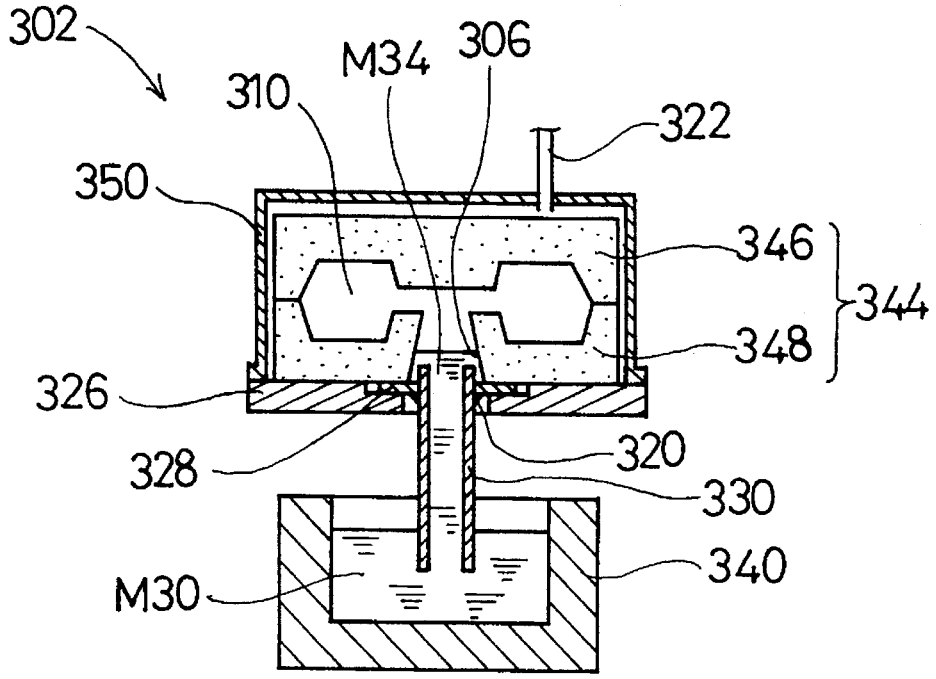
FIGS. 12(A) and 12(B) are sectional views showing the vacuum casting apparatus according to the ninth embodiment.
Figure 12B:
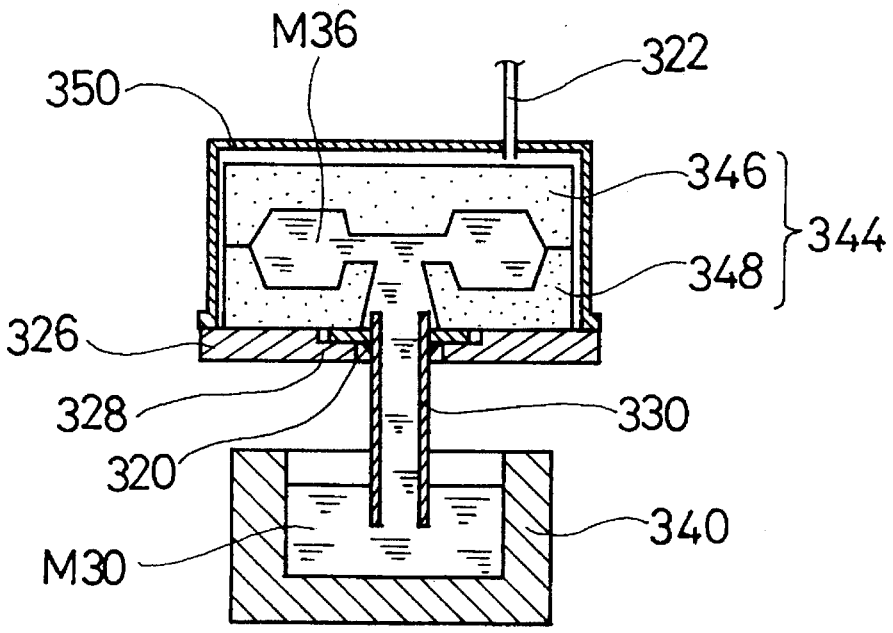
Figure 13:
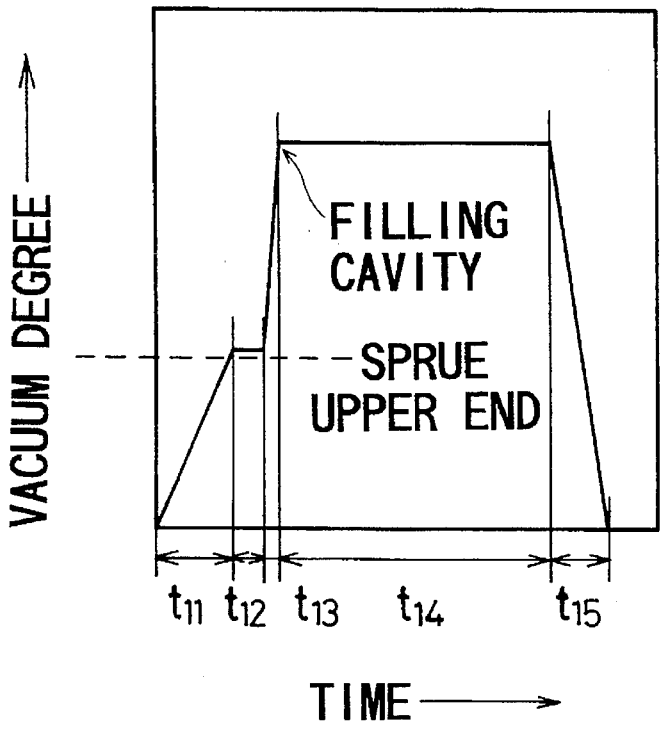
FIG. 13 is a graph showing a vacuum degree control pattern in the vacuum casting apparatus according to the ninth embodiment.

A ninth embodiment of the invention will now be described with reference to FIGS. 11(A), 11(B), 12(A), 12(B) and 13. FIGS. 11(A) and 11(B) are a schematic representation and a fragmentary enlarged-scale view, respectively, showing a vacuum casting apparatus 302 according to a ninth embodiment of the invention. FIGS. 12(A) and 12(B) are sectional views illustrating the manner of the vacuum casting apparatus in this embodiment. FIG. 13 is a view for describing a vacuum degree control pattern in the embodiment.

This embodiment is featured in that the gap between the stalk and flange is filled with molten metal by holding, for a predetermined period of time, a state resulting from overflowing of withdrawn molten metal from the upper end of the stalk.

As shown in FIGS. 11(A) and 11(B), in the vacuum casting apparatus 302, a control unit 314 is connected via a control signal line 314*a* to a vacuum pump 324 for reducing pressure in a gas-tight vacuum chamber 350. In this embodiment, the control unit 314 controls the operation of the vacuum pump 324 such as to adjust the amount of molten metal withdrawn through a stalk 330 (i.e., the height of withdrawal).

In the vacuum casting apparatus 302, like each of the preceding embodiments, a flange 328 and a stalk 330 are mounted on a die 344 via a gas-tight surface plate 326, and the gas-tight chamber 350 is fitted over these components. The pressure in the gas-tight chamber 350 is reduced from a vacuum pump 324 via a vacuum tubing 322 for vacuum casting.

In this embodiment, a seal material 320 is coated over the entire circumference of the contact surfaces of the flange 328 and the stalk 330, as shown in FIG. 11(B). The seal material 320 is a refractory seal material composed of fine refractory particles, an inorganic binder such as colloidal silica, and a small amount of an organic binder. The seal material 320 ensures the gas tightness between the stalk 330 and flange 328 in an initial stage of vacuum casting.

When the vacuum pump 324 is operated, molten metal M30 in the molten metal vessel 340 is withdrawn into the stalk 330, as shown in FIG. 12(A). The operation of the vacuum pump 324 is controlled such that an upper portion M34 of the molten metal fills a lower portion of a sprue 306 of the die 344, as shown in FIG. 12(A). At this time, the stalk 330 is heated by the molten metal, and the seal member 320 is thermally deteriorated to gradually lose the seal property. At the same time, however, the molten metal M34 overflowing from the upper end of the stalk 330 intrudes into between the contact surfaces of the stalk 330 and the flange 328 to be progressively cooled and solidified. Thus, the gas tightness between the stalk 330 and the flange 328 is ensured, and the gas tightness is not lowered despite the thermal deterioration of the seal material 320.

After the gas tightness thus has been secured with the head of molten metal held at the level as shown in FIG. 12(A), the intensity of withdrawal of the vacuum pump 324 is increased to further withdraw molten metal. Thus, molten metal M36 is charged into the cavity 310 in the die 344, as shown in FIG. 12(B). In this way, vacuum casting is obtained.

FIG. 13 shows the manner of vacuum degree changes in the above vacuum casting process. The control unit 314 controls the vacuum degree after the evacuation pattern shown in FIG. 13. Specifically, as shown in FIG. 13, in an initial stage $t_{11}$ of vacuum casting, the vacuum degree is increased as time elapses, causing molten metal to be withdrawn into the stalk 330. When a state is reached in which the molten metal overflows the upper end of the stalk 330 (the state shown in FIG. 12(A)), the corresponding vacuum degree is held for a predetermined period $t_{12}$ of time.

Then, the vacuum degree is increased sharply for a period $t_{13}$ of time. During this time, the molten metal is charged into a cavity 310, as shown in FIG. 12(B). Then, the molten metal in the cavity 310 is cooled down for a period $t_{14}$ of time to be solidified. Then, the vacuum is released for a period $t_{15}$ of time, thus completing the vacuum casting.

In this embodiment, as shown in FIG. 11(B), the seal material 320 is coated on the underside of the flange 328 which is not in direct contact with molten metal. It is thus possible to prevent burning of or gas generation from the seal material that might otherwise result from the contact of the seal material with molten metal. In addition, it is possible to extend the seal retention time.

Further, while in this embodiment, the underside of the die 344 and the upper surface of the flange 328 are held in close contact with each other, it is possible to improve the seal property by providing a gap between these two parts and causing overflowing molten metal to flow into the gap.

Tenth Embodiment

Figure 14:
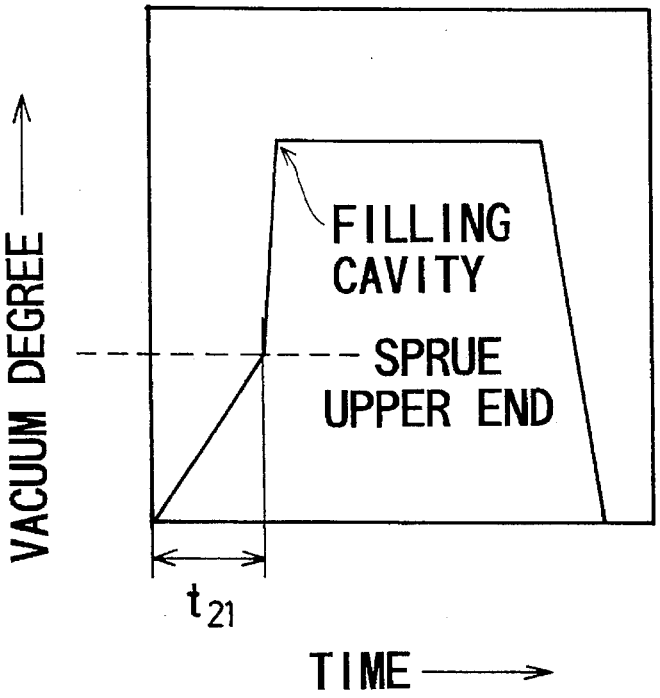
FIG. 14 is a graph showing a vacuum degree control pattern in a vacuum casting apparatus according to a tenth embodiment.

A tenth embodiment of the invention will now be described with reference to FIG. 14. FIG. 14 is a view describing a vacuum degree control pattern in a vacuum casting apparatus according to the tenth embodiment.

This embodiment is featured in that the initial evacuation is done more gently than in the ninth embodiment to increase the time $t_{21}$ until overflowing of molten metal from the upper end of a stalk, as shown in FIG. 14. That is, the rate of evacuation in the initial vacuum casting state $t_{21}$ is set to be lower than in the ninth embodiment.

With this arrangement, it is possible to ensure gas tightness without damage to the seal material which ensures the gas tightness between the stalk and the flange even if the seal material is a hard material which is liable to be ruptured by sudden evacuation.

In this embodiment, the vacuum degree retention time $t_{12}$ in the ninth embodiment is omitted to reduce the casting cycle time.

11th Embodiment

Figure 15:
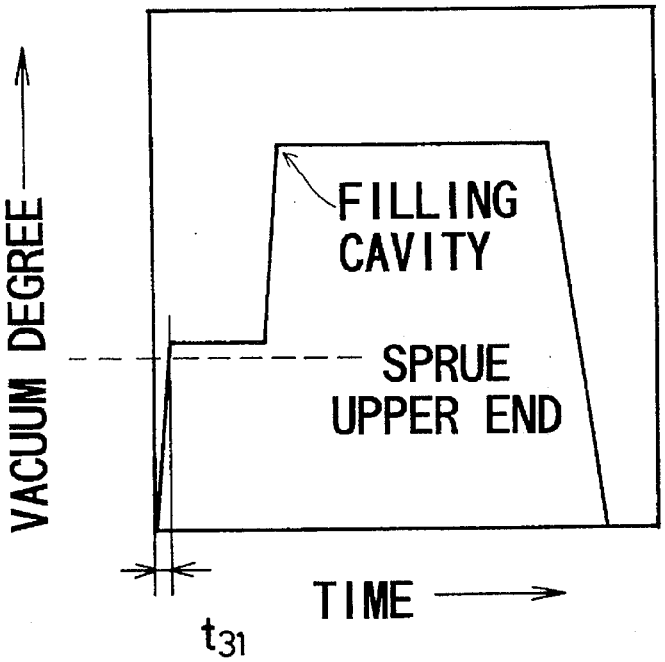
FIG. 15 is a graph describing the manner of vacuum casting in a vacuum casting apparatus according to an 11th embodiment.

An 11th embodiment of the invention will now be described with reference to FIG. 15. FIG. 15 is a view describing a vacuum degree control pattern in a vacuum casting apparatus according to the 11th embodiment.

This embodiment is featured in that, as shown in FIG. 15, the initial evacuation in a vacuum casting is done quickly to reduce time $t_{31}$ until overflowing of molten metal from the upper end of a stalk.

With this arrangement, even where the seal material is an organic material or the like which is prone to deterioration by heating for long time, it is possible to secure gas tightness by causing overflowing and solidification of molten metal before the vacuum degree is reduced due to deterioration of the seal material. In this way, even by using a seal material which is readily subject to thermal deterioration, it is possible to secure gas tightness for satisfactory vacuum casting.

12th Embodiment

Figure 16:
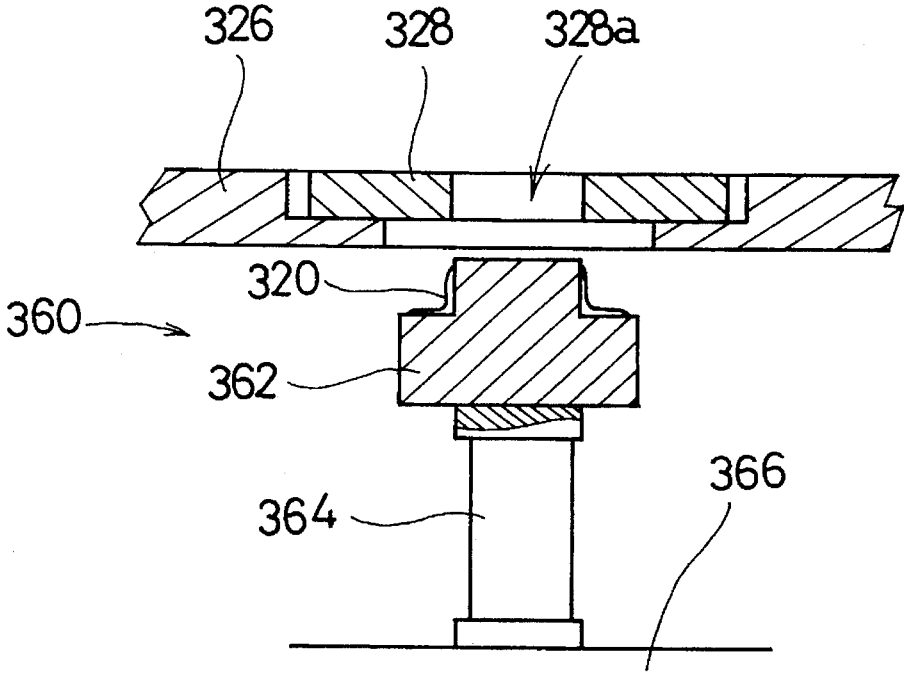
FIG. 16 is a sectional view showing the essential parts of a vacuum casting apparatus according to a 12th embodiment.

A 12th embodiment of the invention will now be described with reference to FIG. 16. FIG. 16 is a sectional view showing the essential parts of a vacuum casting apparatus according to the 12th embodiment.

In this embodiment, after carrying out vacuum casting by using a seal material as in the 9th to 11th embodiments, it is made possible to use the flange again by removing seal material attached thereto.

Specifically, the vacuum casting apparatus of this embodiment has a flange cleaner 360 as shown in FIG. 16. The flange cleaner 360 includes a lift cylinder mechanism 364 installed on a floor 366 and a flange cleaning member 362 secured to the upper end of a lift rod (not shown) of the lift cylinder mechanism 364. The flange cleaning member 362 is a cylindrical member with a shoulder having a sectional profile as shown in FIG. 16. Its top has an outer diameter substantially equal to the inner diameter of an opening 328*a* of a flange 328.

The operation of the flange cleaner 360 having such a construction will now be described. After the vacuum casting using the seal material as in the 9th to 11th embodiments, a gas-tight surface plate 326 is moved by a conveying mechanism (not shown) to a position above the flange cleaner 360 as shown in FIG. 16.

In this state, the lift cylinder mechanism 364 is operated, causing the flange cleaning member 362 to be raised together with a lift rod (not shown) and inserted through the opening 328*a* of the flange 328. Where the flange 328 is of the split type as shown in FIGS. 3(A), 3(B), 4(A), 4(B) and 5, it is tightened by a tightening mechanism (not shown) so that it will not be spread.

Then, the flange cleaning member 362 is rotated by a rotating mechanism (not shown) for frictional contact of the outer periphery of an upper portion of the flange cleaning member 62 with the surface of the flange opening 328*a*. Also, the upper surface of a lower portion of the flange cleaning member 362 is brought into contact with and slides over the lower surface of the flange opening 328*a*. Then, the lift cylinder mechanism 364 is operated to lower the flange cleaning member 362 to be detached from the flange 328.

In this way, the seal material 320 remaining on the periphery of the opening 328*a* of the flange member 328 is adhered to the flange cleaning member 362 and removed.

In this way, the seal material 320 remaining on the flange opening 328*a* is cleaned away, so that the cleaned flange 328 can be used again in the next vacuum casting process.

13th Embodiment

Figure 17:
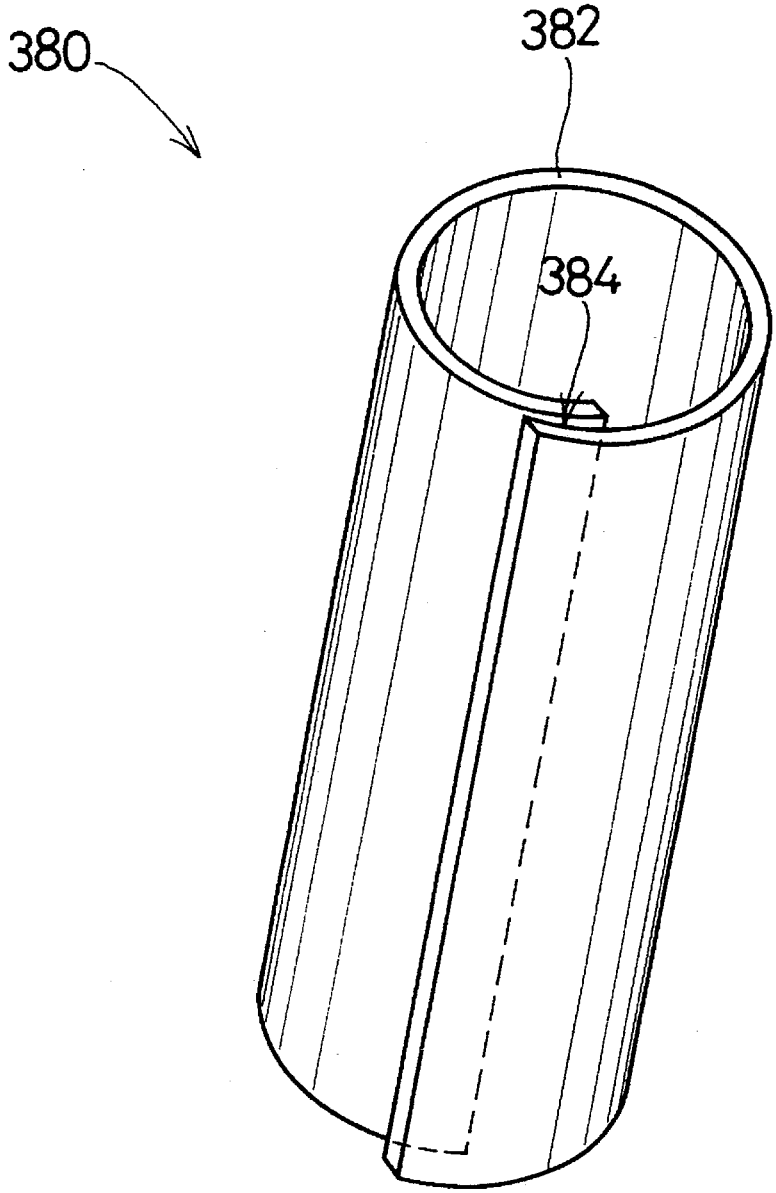
FIG. 17 is a perspective view showing the essential parts of a vacuum casting apparatus according to a 13th embodiment.
Figure 18:
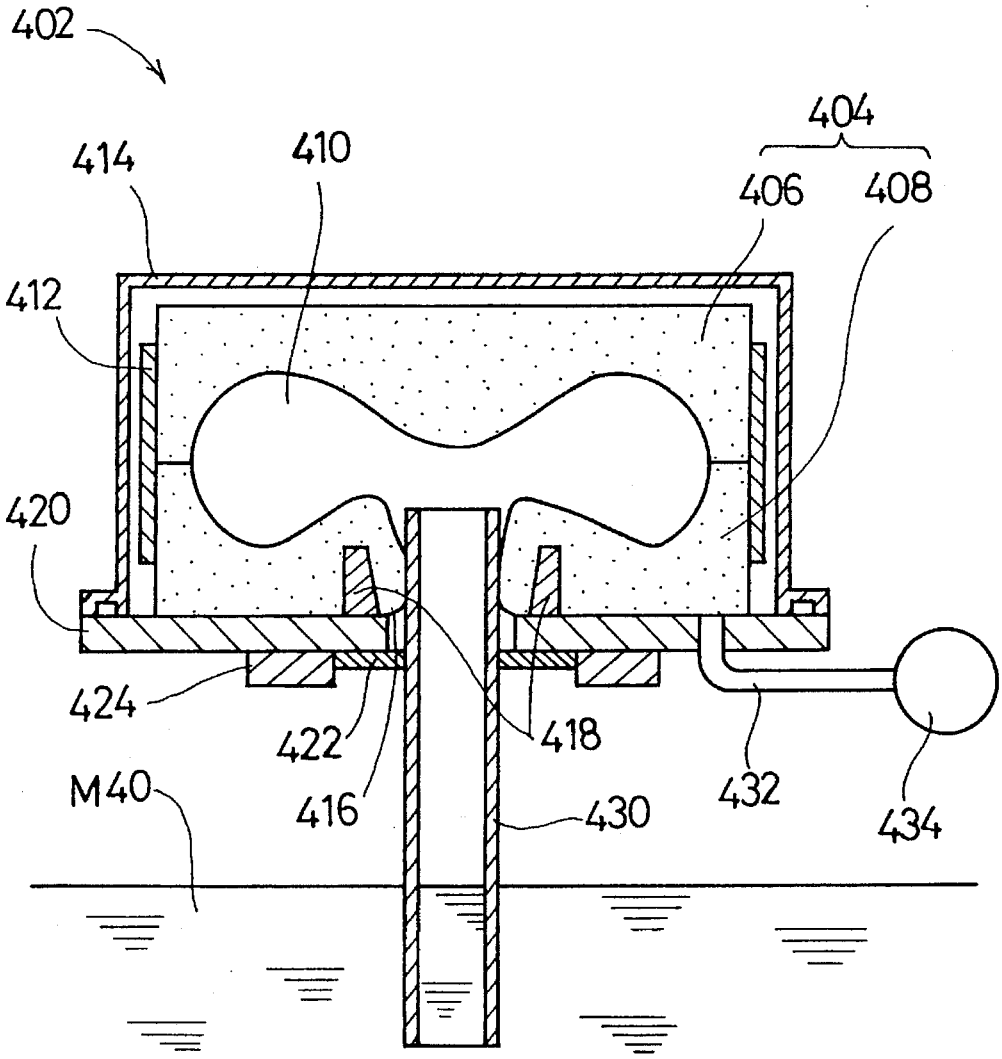
FIG. 18 PRIOR ART
FIG. 18 is a sectional view showing an example of a prior art vacuum casting apparatus.
Figure 19:
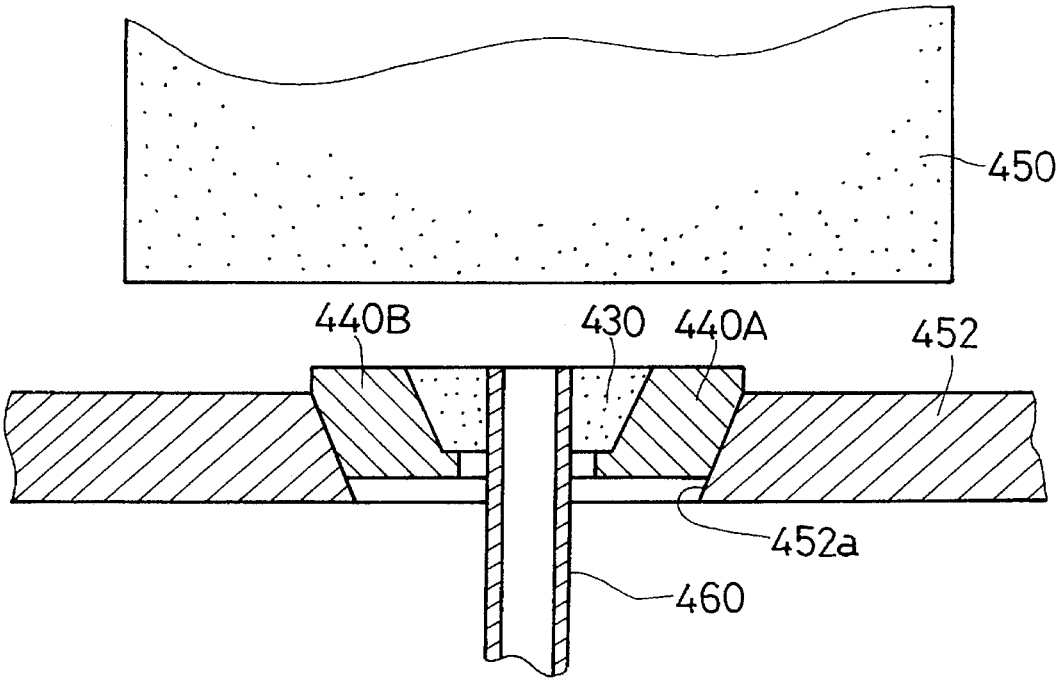
FIG. 19 PRIOR ART
FIG. 19 is a sectional view showing part of another prior art example.
Figure 20:
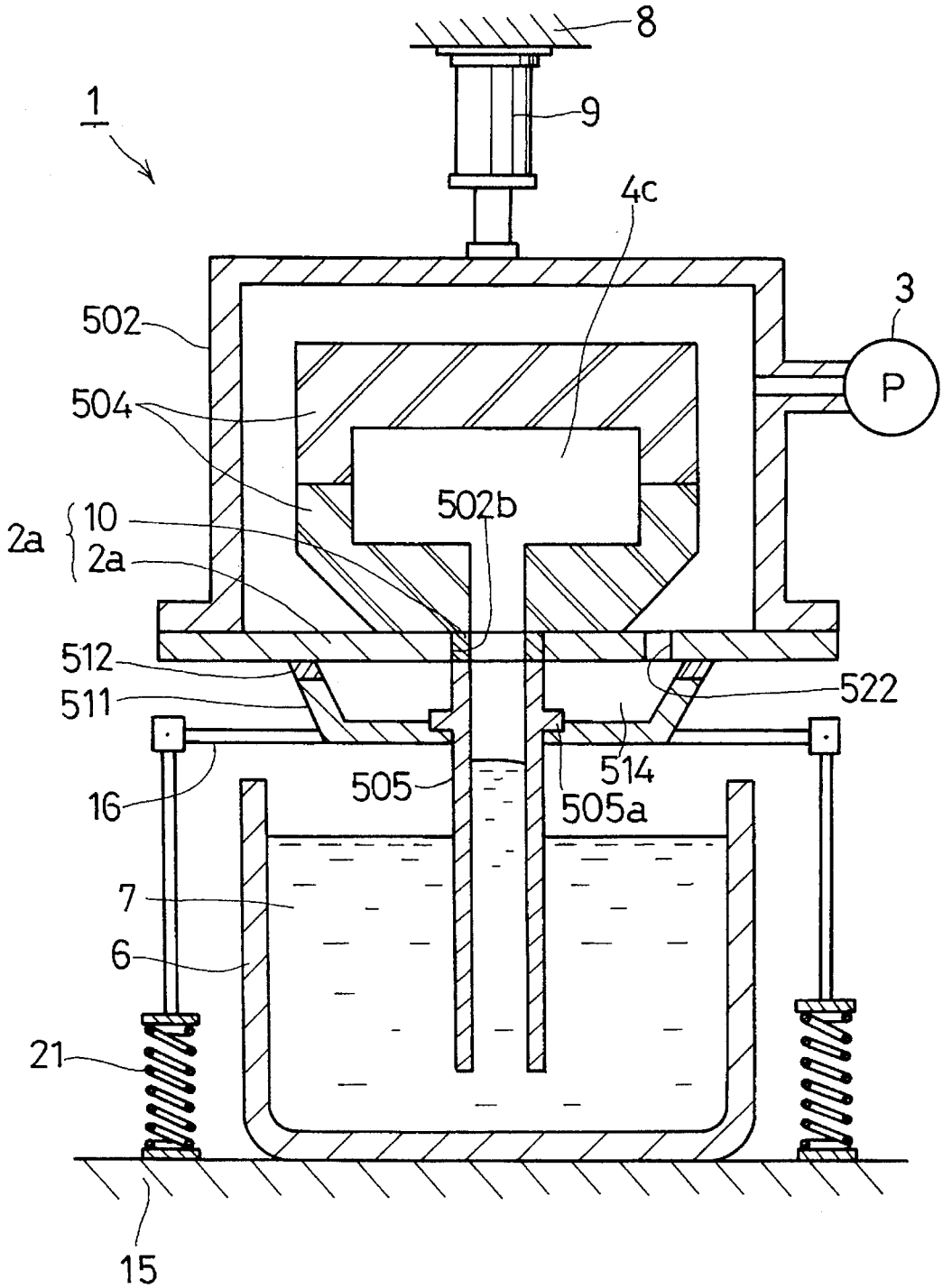
FIG. 20 PRIOR ART
FIG. 20 is a sectional view showing part of a further prior art example.

A 13th embodiment of the invention will now be described with reference to FIG. 17. FIG. 17 is a perspective view showing the construction of a stalk used in a vacuum casting apparatus according to the 13th embodiment of the invention.

In this embodiment, as shown in FIG. 17, a straight-tubular stalk 380 is formed by bending a flat sheet of the same metal material as the casting material into a cylindrical form. A refractory seal material which is the same as in the 9th to 12th embodiments, is coated at a seam 384 of a flat sheet 382 to be provisionally embedded in the gap of the seam 384.

When molten metal is withdrawn into a stalk 380 after the start of the vacuum casting, molten metal intrudes into the gap of the seam 384. Thus, cooled and solidified molten metal is embedded in the gap to make up for the deterioration of the refractory seal material, thus securing gas tightness. As shown, in this embodiment, the gas tightness of the stalk 380 is secured by causing molten metal to flow into the gap of the seam 384 and solidified.

Heretofore, there have been many cases in which a commercially available standard metal pipe is used by cutting it. In such standard metal pipes, there is a predetermined relationship among the pipe diameter, pipe thickness and pipe length, and those in which the relationship is deviated from predetermined ranges have been extremely difficult to be mended.

In this embodiment, however, the stalk 380 is formed from the flat sheet 382, and thus its size can be set freely. It is thus possible to use an optimum stalk in dependence on the size and shape of the molten metal vessel or the die or the temperature or casting amount of the molten metal.

In this embodiment, the refractory material is embedded in the gap of the seam 384 by merely lapping the end portions of the seam 384. Alternatively, it is possible to spot weld the seam 384 without use of any seal material or fold an end of the flat sheet 382, thereby promoting the solidification of the intruded molten metal.

While in the above description of the embodiments, the straight-tubular stalk has been shown to be of a cylindrical shape with a substantially circular sectional profile, it is also possible to use a stalk having an oval sectional profile or the like. Further, it is possible to use a stalk which is partly or entirely curved.

Further, the construction, shape, size, material, quantity, etc. of the other parts of the vacuum casting apparatus are not limited to those in the embodiments.

The vacuum casting apparatus according to the invention has means for reducing the pressure in the space formed between two flanges mounted on the outer periphery of a straight-tubular stalk, and thus it is possible to secure gas tightness of the die cavity without welding the straight-tubular stalk and the flange to each other. It is thus possible to obtain casting having excellent quality. Thus, the vacuum casting apparatus according to the invention is very practical and permits casting of excellent quality to be readily obtained at low cost.

Further, with the vacuum casting apparatus with means for spreading the stalk at the position thereof with the flange mounted, the straight-tubular stalk can be held in close contact with the flange and secure the gas tightness of the die cavity without welding the stalk and the flange to each other. The vacuum casting apparatus is thus very practical and permits casting of excellent quality to be obtained readily and at low cost.

Further, with the vacuum casting apparatus with molten metal embedded in the gap between the stalk and the flange, the gas tightness between the straight-tubular stalk and the flange can be secured without welding together the two parts. Thus, it is possible to obtain a casting product which is free from casting defects and which has excellent quality.

Further, with the vacuum casting apparatus using the split flange capable of being separated from the stalk, the flange can be readily separated after the vacuum casting, and it is readily possible to realize automation of the vacuum casting process. Thus, the vacuum casting apparatus is very practical and readily permits casting of excellent quality to be obtained at low cost.

Further, with the vacuum casting apparatus in which the straight-tubular stalk is formed by bending a flat sheet and embedding molten metal in the gap of the seam of the sheet in the initial vacuum casting stage, it is possible to freely select the diameter, thickness and length of the stalk. Thus, an optimum size stalk can be used in dependence on the die cavity size, molten metal temperature, etc., and the vacuum casting apparatus is very practical and permits casting of excellent quality readily and at low cost.

While the invention has been described with reference to preferred embodiments thereof, it is to be understood that modifications or variations may be easily made without departing from the scope of the present invention which is defined by the appended claims.

What is claimed is:

1. A vacuum casting apparatus comprising:

a gas-tight chamber having an insertion hole for inserting a stalk and evacuated when performing vacuum casting;

a die accommodated in said gas-tight chamber;

a straight-tubular stalk inserted through the insertion hole of said gas-tight chamber for leading molten metal into said die; and a first flange and a second flange mounted on an outer periphery of an insertion side end of said stalk in a spaced-apart relation in the longitudinal direction of said stalk, a flange surface of said first flange being in close contact with said gas-tight chamber, a flange surface of said second flange being in close contact with said die, a space between said first and second flanges being communicated with evacuating means.

2. The vacuum casting apparatus according to claim 1, wherein said flanges are split in a direction substantially perpendicular to the longitudinal direction of said stalk.

3. The vacuum casting apparatus according to claim 1, wherein said straight-tubular stalk is formed by bending a sheet of the same material as the molten metal, and wherein the molten metal is caused to intrude into and be solidified in a seam of the sheet in an initial vacuum casting stage.

4. A vacuum casting apparatus comprising:

a gas-tight chamber having an insertion hole for inserting a stalk and evacuated when performing vacuum casting;

a die accommodated in said gas-tight chamber;

a straight-tubular stalk inserted through the insertion hole of said gas-tight chamber for leading molten metal into said die;

a flange mounted on an outer periphery of an insertion side end of said stalk; and stalk spreading means for spreading the insertion side end of said stalk, thus bringing the outer periphery of said stalk into close contact with the inner periphery of said flange.

* * * * *